US006447386B1

(12) United States Patent
LaPointe

(10) Patent No.: US 6,447,386 B1
(45) Date of Patent: Sep. 10, 2002

(54) PRESSER ROLL FOR SURFACE PLANNER

(75) Inventor: André LaPointe, St-Come (CA)

(73) Assignee: OSI Machinerie Inc., Beauce (CA)

( * ) Notice: Subject to any disclaimer, the term of this patent is extended or adjusted under 35 U.S.C. 154(b) by 0 days.

(21) Appl. No.: 09/660,126

(22) Filed: Sep. 12, 2000

(51) Int. Cl.[7] ..... B24B 19/00

(52) U.S. Cl. ..... 451/424; 451/177; 451/178; 451/194; 451/207

(58) Field of Search ..... 451/177, 178, 451/194, 207

(56) References Cited

U.S. PATENT DOCUMENTS

| | | | | |
|---|---|---|---|---|
| 3,858,631 A | | 1/1975 | Anderson et al. | |
| 4,322,919 A | | 4/1982 | Gerber | |
| 5,921,848 A | * | 7/1999 | Zang et al. | 451/57 |

* cited by examiner

*Primary Examiner*—Joseph J. Hail, III
*Assistant Examiner*—Shantese McDonald
(74) *Attorney, Agent, or Firm*—Merchant & Gould P.C.

(57) ABSTRACT

A presser roll for surface planers is described herein. The presser roll comprises a longitudinal shaft, a radially deformable generally cylindrical sleeve mounted on said longitudinal shaft for rotation in unison therewith and a biasing assembly mounted between the shaft and the sleeve for outwardly biasing the sleeve.

19 Claims, 4 Drawing Sheets

PRESSER ROLL FOR SURFACE PLANNER

FIELD OF THE INVENTION

The present invention relates to surface planers. More specifically, the present invention is concerned with presser rolls for centering and feeding lumber to a surface planer.

BACKGROUND OF THE INVENTION

Surface planers are commonly known for surfacing workpieces. Such machines are provided with one or more heads that include, for example, an abrasive belt or a plurality of teeth. It is to be noted that the expression "surfacing" is intended hereinbelow to include any surfacing operation, such as sanding and grinding.

Many surface planers are provided with two opposite abrasive heads, thus allowing simultaneous processing of both sides of a workpiece, A precise spacing of the two opposite heads allows the operator to control of the thickness of the resulting workpiece. Although such control may be accurate for straight lumber, problems arise with lumber that is significantly warped. Indeed, the warpage may cause unequal surfacing on both sides of the lumber.

According to the prior-art, opposite and fixedly mounted rollers are generally provided upstream of the abrasive heads as a feed system forcing the warped lumber therethrough.

A drawback of fixedly mounted rollers is that they may cause badly warped lumber to crack under the pressure generated by the two rollers.

Another drawback of feeding systems equipped with fixed rollers is that they limit the precision of the planing process. Indeed, lumber having a thickness less then the nominal value may be surfaced unequally on both sides and a thicker piece may be too large for the feeding system.

A solution to these drawbacks has been proposed by Gerber in U.S. Pat. No. 4,322,919, issued on Apr. 6, 1982 and entitled "Self-Centering Feed Mechanism for an Abrasive Grinding Machine". Gerber proposes a feeding system that includes a control arm mechanism provided with pneumatic actuator that permits the control arm mechanism to be deflected away from the center plane as it engages a workpiece.

A first drawback of Gerber's system is that it cannot be installed in a conventional planer without making modifications thereto. Moreover, Gerber's system has several mechanical components, therefore increasing the need for maintenance and the possibility of malfunctions.

Gerber's system is also relatively bulky and takes up working space.

SUMMARY OF THE INVENTION

More specifically, in accordance with the present invention, there is provided a presser roll for a surface planer comprising:

- a longitudinal shaft;
- a generally cylindrical sleeve mounted on the longitudinal shaft for rotation in unison therewith; the sleeve being radially deformable; and
- a biasing assembly mounted between the shaft and the sleeve; the biasing assembly outwardly biasing the sleeve.

Other objects, advantages and features of the present invention will become more apparent upon reading the following non-restrictive description of preferred embodiments thereof, given by way of example only with reference to the accompanying drawings.

DESCRIPTION OF THE PREFERRED EMBODIMENT

Figure 1:
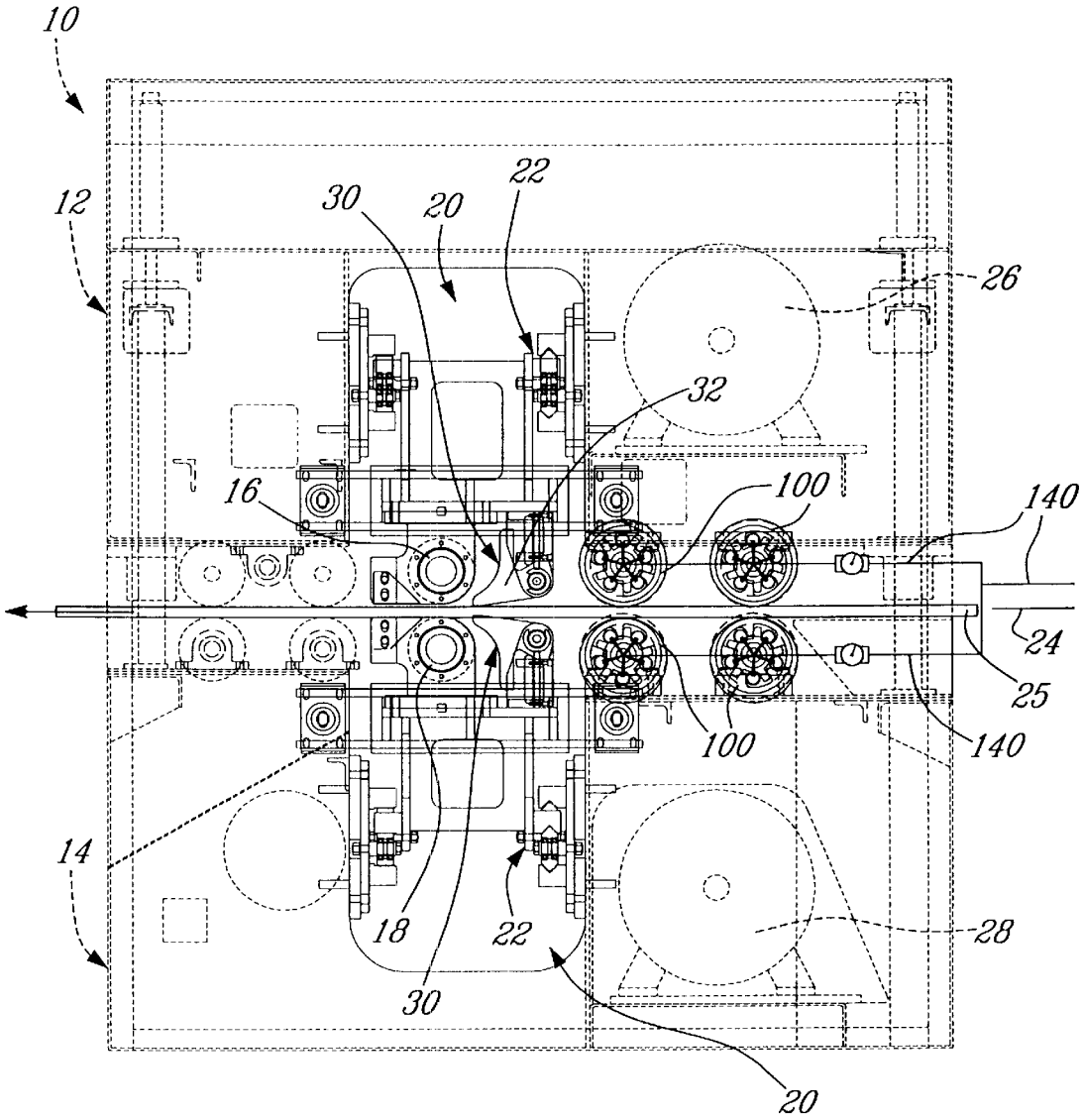
FIG. 1 is a side elevational view of a surface planer equipped with presser rolls according to an embodiment of the present invention.
Figure 2:
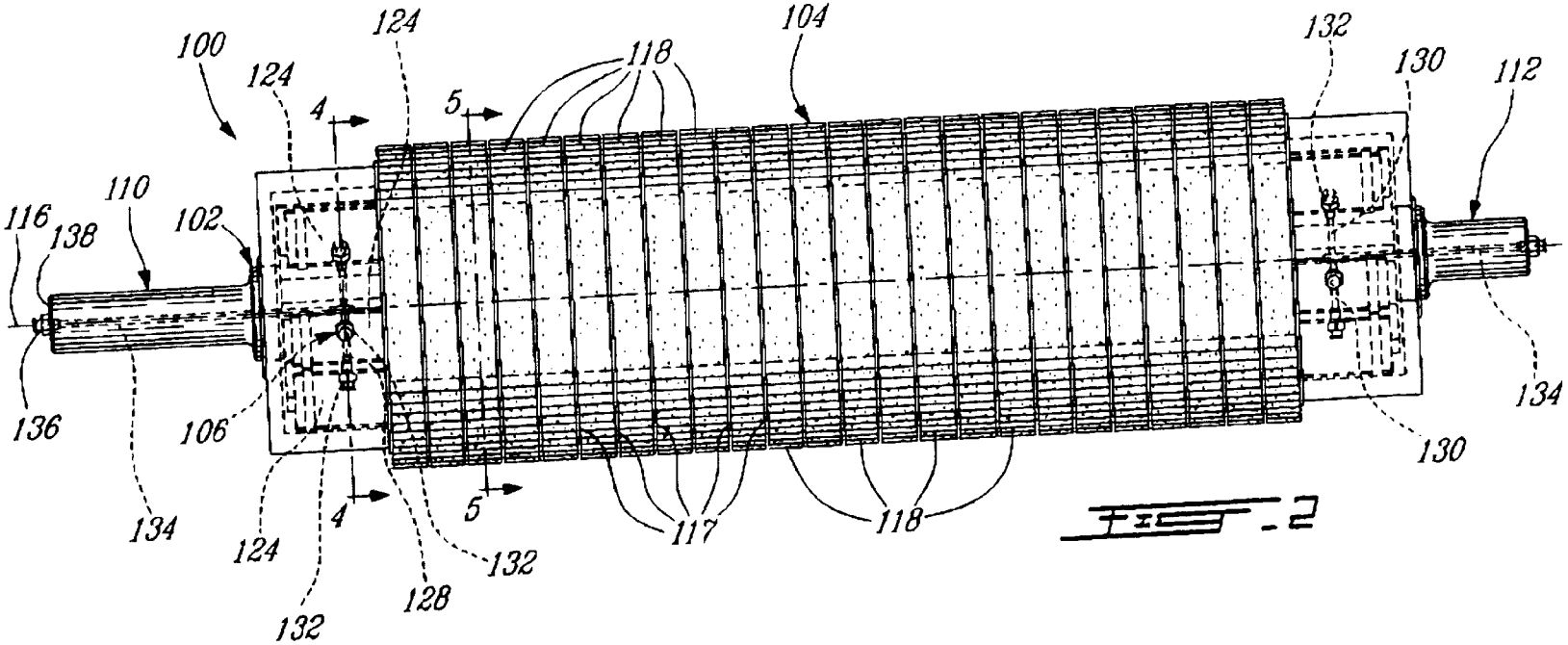
FIG. 2 is a front elevation view of a presser roll of FIG. 1.

Turning now to FIG. 1 of the appended drawings, a surface planer 10 incorporating four (4) presser rolls 100, according to an embodiment of the present invention, will be described. Since surface planers are believed well known in the art and for concision purposes, only the features of the planer related to the present invention will be described herein.

The surface planer 10 comprises upper and lower frames 12 and 14, having opposite cylindrical abrasive heads 16 and 18. Each abrasive head 16–18 is rotatably mounted to its respective frame via a mounting assembly 20.

Each mounting assembly 20 includes a head adjustment mechanism 22 to adjust the distance of the dual heads 16 and 18 from the symmetrical center plane 24 A transmission assembly (not shown) for transferring the rotational movement of motors 26 and 28 to respective heads 16 and 18 and is also part of each mounting assembly 20.

Opposite guide assemblies 30 are also mounted to the mounting assemblies 20, near the dual abrasive heads 18 and 18. The guide assemblies 30 include respective presser heads 32 so pivotally mounted to the mounting assemblies 20 as to be biased toward the center plane 24.

Two pairs of opposite presser rolls 100 are rotatably mounted to the frames 12 and 14 upstream from the abrasive heads 16 and 18 on both sides of the center plane 24.

The main functions of the presser rolls 100 is to feed pieces of lumber 25 toward the abrasive heads 16–18 while centering such pieces of lumber 25 about the center plane 24.

Each presser rolls 100 is advantageously actuated by independant hydraulic motors (not shown).

As will be apparent to one skilled in the art, presser rolls mounted to the upper and lower frames 12 and 14 rotate in opposite directions.

The abrasive heads 16–18 and the presser rolls 100 are so mounted to the frames 12 and 14 as to be movable in unison. Therefore, the distance between the two pairs of facing presser rolls 100 is advantageously adjusted via the head adjustment mechanism 22 as in the case of the two opposite abrasive heads 16–18.

As will be explained hereinbelow, the surface planer 10 advantageously includes means to actuate the biasing effect of the presser rolls 100 towards the center plane 24.

It is to be noted that the general configuration of the surface planer 10, and the number and position of the presser rolls 100 may vary without departing from the spirit of the present invention, as will be described hereinbelow.

Turning now to FIGS. 2 to 5, a presser roll 100, according to an embodiment of the present invention, will be described in more detail.

The presser roll 100 comprises a longitudinal shaft 102, a generally cylindrical sleeve 104 mounted on the longitudinal shaft 102, and a biasing assembly 106 generally mounted between the shaft 102 and the sleeve 104.

The longitudinal shaft 102 includes a central portion 108 first and second generally cylindrical handle portions 110–112 longitudinally extending from the central portion 108.

Figure 5:
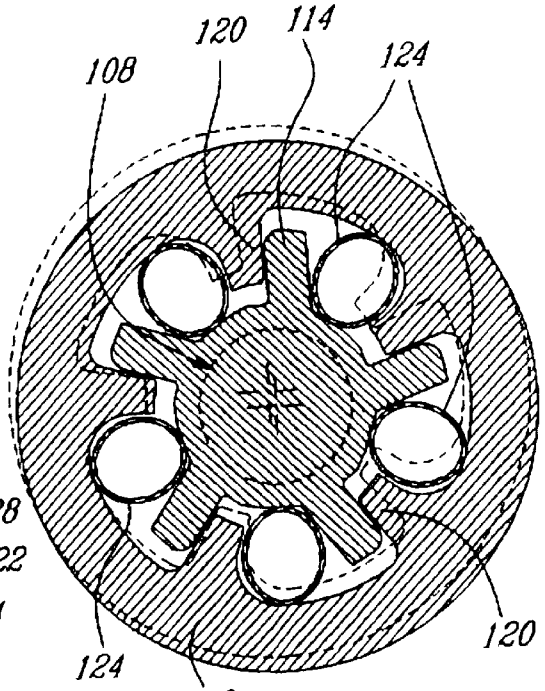
FIG. 5 is a sectional view taken along line 5—5 of FIG. 2.
Figure 4:
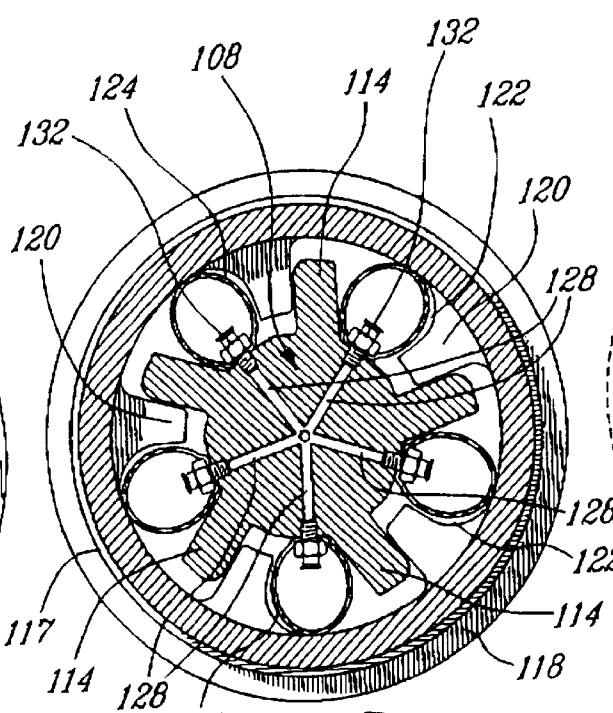
FIG. 4 is a sectional view taken along line 4—4 of FIG. 2.
Figure 3:
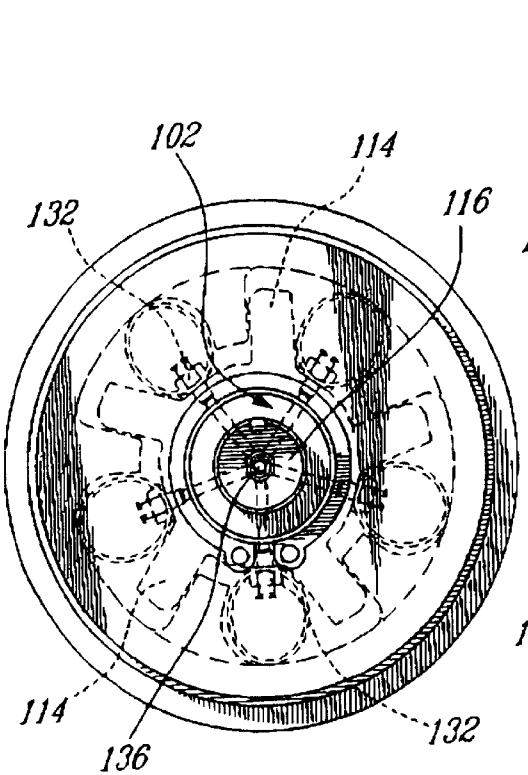
FIG. 3 is a side elevation view of the presser roll of FIG. 2.

As can be better seen from FIGS. 3–5, the central portion 108 is provided with a plurality of radial projections 114 (five in the illustrated embodiment), extending throughout the length of the central portion 108.

For reasons that will be explained in the following description, the projections 114 are advantageously tilted from equidistant imaginary rays (not shown) extending from the rotational axis 116.

The first and second handle portions 110–112 are integrally mounted to the central portion 108. They are configured and sized to allow the longitudinal shaft 102 to be rotatably mounted to the surface planer 10. Their configuration may therefore vary to accommodate the surface planer to which they are to be mounted.

Alternatively, the handle portions 110–112 may be removably mounted to the central portion 108 and secured via conventional securing means such as bolts.

A plurality of separate rings 118 is mounted on the central portion 108 of the longitudinal shaft 102. The rings are advantageously made of steel. Other heavy-duty material can also be used.

To increase the friction between the presser roll 100 and a piece of lumber, the outer surface of the presser roll 100 is advantageously corrugated. The friction may contribute to the movement of a piece of lumber toward the abrasive heads 16–18 while helping to prevent transversal slippage.

Optionally, the outer surface of the presser roll 100 may be covered with a resilient material that will help protect the lumber when contacted by the presser roll 100.

Conventional friction rings 117 are mounted between the rings 118 to help prevent fiction between adjacent rings 118. These rings 117 are advantageously made of Nylon™.

The plurality of separate rings 118 forms a generally cylindrical sleeve 104 that is radially deformable.

Each ring 118 includes a plurality of generally radial internal protrusions 120 (five on the illustrated embodiment) configured, sized and positioned to be engaged by the radial projections 114 of the longitudinal shaft 102. Rotation of the shaft 102 will therefore cause the rotation of rings 118 in unison (see arrow 119 in FIG. 4).

Protrusions 120 may be either integrally molded to the rings 118 or secured thereto using fastening means such as rivets, glue or other equivalent fastening means.

Each ring 118 is advantageously configured and sized to provide a plurality of bores 122 between consecutive projections 114 and protrusions 120.

Inflatable closed tubes 124 are advantageously inserted in the bores 122. These tubes 124 are part of the biasing assembly 106. This assembly 106 may also includes an air feeding mechanism to cause an adjustable radial expansion of the tubes 124.

The angle of the projections 114 provides a better contact with the protrusions 120 and allows sufficient space to receive the tubes 124.

When air is forced in the closed tubes 124 through apertures 126, the tubes 124 expand and then exert a force unto the rings 118 that outwardly biases the rings 118. Air is brought to the tubes 124 via apertures 128, 130 and 134 that are advantageously provided in the shaft 102.

As can be better seen in FIGS. 1 and 4, the central portion 108 of the shaft 102 is advantageously provided with two series of radial distributing apertures 128 and 130, each located near respective handle portions 110 and 112. Apertures 128 and 130 extend from the rotational axis 116 to the outer surface of the central portion 108.

Each of the apertures 128 and 130 are radially positioned near a bore 122 Small pipe couplings 132 are used to both secure the tubes 124 to the shaft 102 in the bores 122 and create a fluid communication between the apertures 128–130 and the tubes 124.

The shaft 102 includes an air feeding aperture 134 centered about the rotational axis 116, that extends throughout its length intersecting the distributing apertures 128–130. A pipe coupling 136 is advantageously provided at the proximate end 138 of the handle portion 110 to allow heretic connection of an air feeding assembly 140 (see FIG. 6).

The pipe coupling 138 advantageously includes a rotatable portion to receive an air feeding pipe and a fixed portion to be mounted to the distributing aperture 134. The air-feeding aperture 134 is air-sealed at the end opposite the pipe coupling 136.

As will now appear more apparent, the air feeding assembly formed by apertures 128, 130 and 134 and by pipe couplings 132 and 138 advantageously allows to feed air to the tubes 124 while the presser roll 100 rotates.

Figure 6:
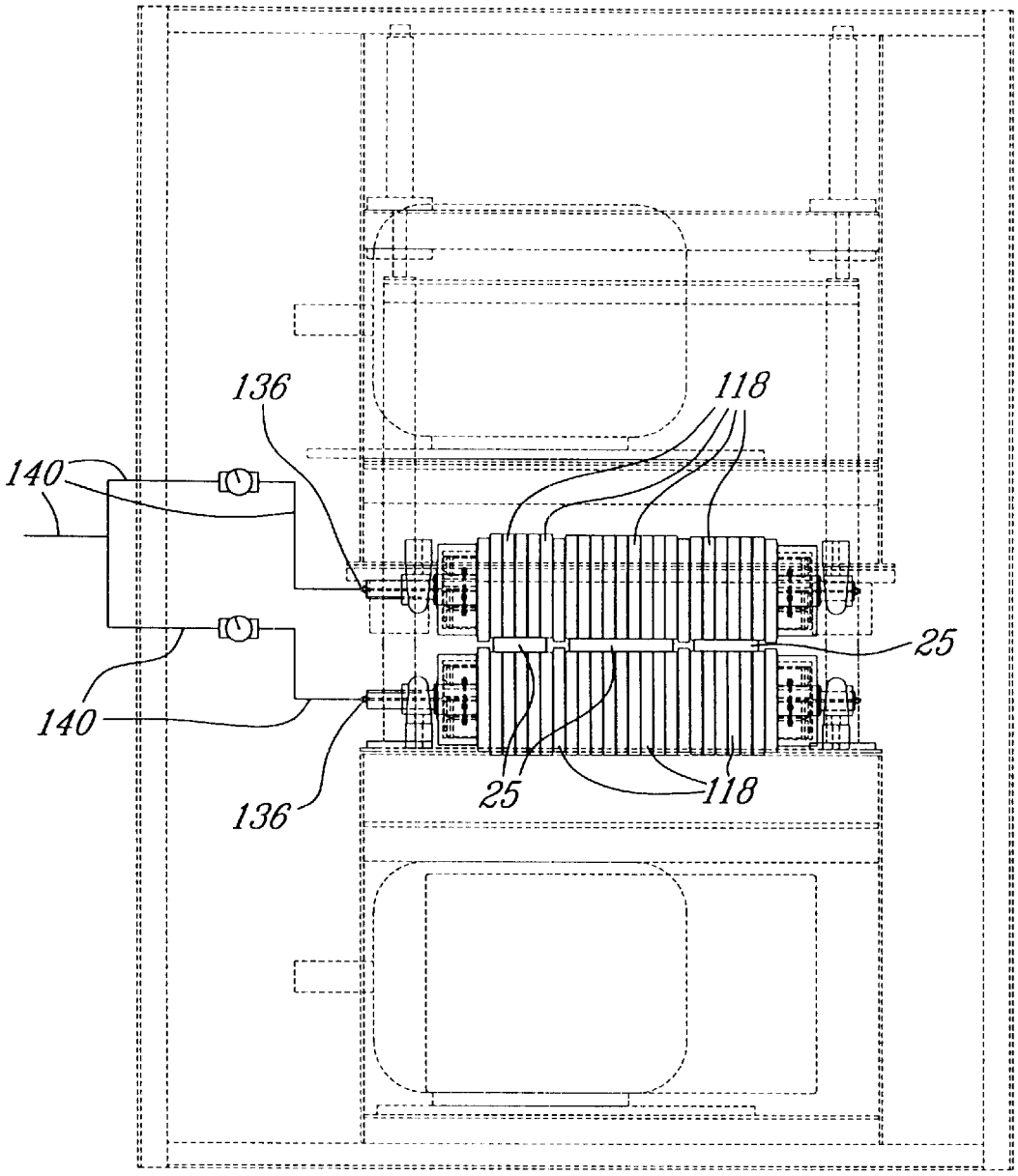
FIG. 6 is a front elevational view of the surface planer of FIG. 1.

With reference to FIG. 6, the operation of the presser rolls 100 will now be briefly described.

The biasing assembly 106 is actuated by feeding air to the tubes 124 via the pipe coupling 136. As discussed hereinabove, this causes the rings 118 to be independently biased outwardly. The biasing effect may be adjusted by varying the pressure of the incoming air from, for example, an air compressor (not shown).

Indeed, a control system (not shown) may advantageously be connected to the presser rolls 100 to monitor the air pressure therein Additionally, such control may also be configured to automatically adjust the air pressure in the presser rolls 100, The rotation of the presser rolls 100 is actuated by energizing independent motors (not shown) mounted thereto, as discussed hereinabove.

When pieces of lumber 25 are fed to the surface planer 10 between the pairs of rollers 100, their rotation forces the pieces of lumber 25 towards the abrasive heads 16 and 18 as it is conventionally known.

Of course, a contact between the lower portion of a disk 118 and the piece of lumber 25 will cause displacement of the ring 118 as can be seen in dashed lines in FIG. 5. This displacement will cause the deformation of the corresponding tube 124 that will force the ring 118 in its original position when the contact is terminated.

Since the biasing assembly 106 allows the presser rolls 100 to be displaced differently along their longitudinal positions by the separate movements of the rings 118 and since an equal air pressure is supplied to each roller 100, a surface planer equipped with presser rolls according to the present invention allows the lumber to be correctly positioned between the abrasive heads, even if the lumber is badly warped or has local deformations. An adequate contact between the rolls 100 and the lumber 25 is therefore constantly achieved.

An advantage of the presser roll 100 over presser rolls mounted to control arms, as proposed in the prior-art, is that it can replace conventional rolls on a most conventional surface planer without requiring major modification thereto.

Another advantage of a presser roll according to the present invention over the prior-art is that it allows to simultaneously feed to the abrasive heads lumber having a different geometry (see, for example, FIG. 6).

It is to be noted that the size and number of the rings 118 may be modified to Increase the precision of the work to be performed on the lumber or to accommodate different types of lumber and the speed of the process.

Alternatively, the biasing assembly could be actuated by hydraulic components.

It is to be noted that the number and positions of the resilient tubes may vary without departing from the spirit and nature of the present invention.

Alternatively, the biasing assembly may include ring-shaped tubes, inserted between the longitudinal shaft and each ring 118. The tubes 124 may also be replaced by pistons connected to the apertures 128.

As will be apparent to a person skilled in the art, the adjustable biasing assembly shown in the appended drawings could be replaced by a non adjustable biasing assembly made of resilient tubes (not shown) that would have a known deformation under load.

Other biasing means can also be used without departing from the spirit and nature of the present invention.

Although the present invention has been described hereinabove by way of preferred embodiments thereof, it can be modified without departing from the spirit and nature of the subject invention, as defined in the appended claims.

What is claimed is:

1. A presser roll for a surface planer comprising:

a longitudinal shaft;

a generally cylindrical sleeve mounted on said longitudinal shaft for rotation in unison therewith; said sleeve being radially deformable; and a biasing assembly mounted between said shaft and said sleeve; said biasing assembly outwardly biasing said sleeve.

2. A presser roll as recited in claim 1, wherein said generally cylindrical sleeve includes a plurality of rings; each of said plurality of rings being so mounted to said shaft as to be radially deformable.

3. A presser roll as recited in claim 1, wherein said biasing assembly includes at least one resilient tube mounted between said shaft and said cylindrical sleeve;

whereby, in operation, said at least one resilient tube produces an outwardly biasing force unto said rings.

4. A presser roll as recited in claim 3, wherein said at least one resilient tube is inflatable.

5. A presser roll as recited in claim 4, wherein said at least one resilient tube is hydraulically inflatable.

6. A presser roll as recited in claim 4, said at least one resilient tube is pneumatically inflatable.

7. A presser roll as recited in claim 4, wherein longitudinal shaft includes at least one aperture to feed said at least one inflatable tube.

8. A presser roll as recited in claim 4, further comprising pipe couplings to connect said at least one inflatable tube to said at least one aperture.

9. A presser roll as recited in claim 4, wherein said longitudinal shaft includes at least one handle portion; said handle portion being configured to rotatably mount the presser roll to the surface planer; at least one aperture in said longitudinal shaft extending through said at least one handle portion; said handle portion including a pipe coupling at the end of said at least one of aperture.

10. A presser roll as recited in claim 1, wherein said longitudinal shaft includes at least one radial projection and each of said rings includes at least one protrusion to be engaged by at least one radial projection of the shaft for rotation in unison.

11. A presser roll as recited in claim 10, wherein the number of protrusions and projections is five.

12. A presser roll as recited in claim 11, wherein said biasing assembly includes five resilient tubes; each of said five resilient tubes being mounted between consecutive protrusion and projection;

whereby, in operation, said resilient tubes produces an outwardly biasing force unto said rings.

13. A presser roll as recited in claim 12, wherein said tubes are inflatable.

14. A presser roll as recited in claim 13, wherein longitudinal shaft includes at least one aperture to feed said inflatable tubes.

15. A presser roll as recited in claim 14, further comprising pipe couplings to connect said inflatable tubes to said at least one aperture.

16. A presser roll as recited in claim 15, wherein said longitudinal shaft includes at least one handle portion; said handle portion being configured to rotatably mount the presser roll to the surface planer; said at least one aperture in said longitudinal shaft extending through said at least one handle portion; said handle portion including a pipe coupling at the end of said at least one of aperture.

17. A presser roll as recited in claim 10, wherein said biasing assembly includes at least one piston; each of said at least one piston being mounted between consecutive protrusion and projection;

whereby, in operation, said at least one piston produce an outwardly biasing force unto said rings.

18. A presser roll as recited in claim 1, wherein at least one of said plurality of rings is made of steel.

19. A presser roll for a surface planer comprising:

a longitudinal shaft;

shaft covering means mounted on said longitudinal shaft for rotation in unison herewith; said shaft covering means being radially deformable; and biasing means mounted between said shaft and said covering means, for outwardly biasing said sleeve.

* * * * *